US005204704A

United States Patent [19]

Genno et al.

[11] Patent Number: 5,204,704

[45] Date of Patent: Apr. 20, 1993

[54] THERMAL TRANSFER PRINTER AND METHOD OF CONTROLLING PRINT DENSITY IN THERMAL TRANSFER PRINTING USING THE SAME

[75] Inventors: Hirokazu Genno; Yoshio Ozawa, both of Hirakata; Yoshihisa Fujiwara, Kadoma, all of Japan

[73] Assignee: Sanyo Electric Co., Ltd., Osaka, Japan

[21] Appl. No.: 695,923

[22] Filed: May 6, 1991

[30] Foreign Application Priority Data

May 11, 1990 [JP] Japan ..... 2-121988

[51] Int. Cl.[5] ..... B41J 2/32

[52] U.S. Cl. ..... 346/76 PH

[58] Field of Search ..... 346/76 PH

[56] References Cited

U.S. PATENT DOCUMENTS 4,587,530 5/1986 Noguchi ..... 346/76 PH 4,704,618 11/1987 Gotoh et al. ..... 346/76 PH 4,887,092 12/1989 Pekruhn et al. ..... 346/76 PH

OTHER PUBLICATIONS

Development of High-Definition Video Copy Equipment, Hori et al., 1986 IEEE, pp. 283-289.

*Primary Examiner*—Mark J. Reinhart

*Attorney, Agent, or Firm*—Darby & Darby

[57] ABSTRACT

A method of controlling printed density in thermal transfer printing includes the steps of: forming a density table representing relation between input energy and actual printed density when there is no temperature gradient in a thermal head; determining a temperature gradient coefficient for estimating a temperature gradient between a heating element and a temperature detector in the thermal head for the nth line; and calculating density correcting amount based on a ratio of the temperature gradient coefficient of the nth line to the temperature gradient coefficient when the thermal head is at a steady temperature gradient state. Apparatus is also provided for carrying out the method.

4 Claims, 6 Drawing Sheets

THERMAL TRANSFER PRINTER AND METHOD OF CONTROLLING PRINT DENSITY IN THERMAL TRANSFER PRINTING USING THE SAME

BACKGROUND OF THE INVENTION

1. Field of the Invention

The present invention relates to a method of controlling print density in thermal transfer printing and, more specifically, to a method of accurately controlling density grade in a dye diffusion type thermal transfer printing.

2. Description of the Background Art

FIG. 1 schematically shows an example of a main portion of a thermal transfer printer. In such a thermal transfer printer as shown in FIG. 1, an ink sheet 2 drawn from an ink sheet supplying roll 1 is overlapped with a sheet of recording paper 5 between a thermal head 3 and a platen roller 4. The thermal head 3 comprises a plurality of heating elements 3*a* arranged in a line in a direction orthogonal to the sheet of the drawing. Energy pulses corresponding to desired print density are applied to the heating elements 3*a*, whereby dye diffusion type ink on the ink sheet 2 is transferred on the sheet of the recording paper 5 and thermal transfer printing is effected. These heating elements 3*a* are formed by register elements, and the energy pulses are applied as electric energy pulses. The amount of energy of each energy pulse can be controlled by changing the width of pulse current or by the changing voltage level of pulse current. After thermal transfer printing, the ink sheet 2 is separated from the printed sheet of the recording paper 5 along a separation board 6 to be wound up around an ink sheet winding roll 7. The sheet of recording paper 5 is moved at the same speed as the ink sheet 2 by means of a capstan roller 8 and a capstan pressure roller 9.

Now, when printing is continued by repeatedly applying energy pulses of a predetermined energy to the heating elements 3*a*, part of the heat generated by the heating elements 3*a* is stored in the thermal head 3. Consequently, the temperature of the thermal head 3 gradually increases, and finally it reaches a steady temperature. At this time, temperature gradient in the thermal head 3 is at a steady state, and this state is hereinafter referred to as the steady temperature state of the thermal head 3. When energy pulses are applied to the heating elements 3*a* with the temperature of the thermal head 3 already increased, the actual printed density becomes higher than when the same energy pulses are applied to the heating elements 3*a* with the temperature of the thermal head 3 being low.

FIG. 2 is a cross sectional view of a thermal head having a temperature detector. This thermal head 3 includes a plurality of heating elements 3*a* on the lower side, and a temperature detector 3*b* including a thermister on the upper side.

FIG. 3 is a graph showing relation between energy pulses determined by using the thermal head of FIG. 2 and the actual printed density, dependent on the steady temperature of the thermal head 3 (temperature of the thermal head 3 when temperature gradient from the heating elements 3*a* to the temperature detector 3*b* is at the steady state). In the graph, the abscissa represents thermal energy (mJ/dot) applied to one heating element corresponding to one print dot, and the ordinate represents actual printed density represented by OD (Optical Density) value. Curves represented by a solid line, a dotted line and a chain dotted line correspond to the steady temperature of 30° C., 40° C. and 50° C., respectively, of the thermal head 3 measured by the temperature detector 3*b*. The maximum available density (e.g., 2.00) depends on a recording ink, while the minimum density (e.g., 0.08) depends on the recording paper.

As will be understood from the graph of FIG. 3, the actual printed density is influenced by the temperature of the thermal head 3, and it is not always proportional to the pulse energy applied to the heating elements 3*a*. Accordingly, adjustment of energy applied to the heating element 3*a* by means of a head driver referring to a density table prepared based on the graph such as shown in FIG. 3 has been proposed. However, since such a density table is formed assuming that the thermal head 3 is at the steady temperature state, the actual printed density at the start of printing when the thermal head 3 is at non-steady state or the actual printed density when low density printing is abruptly changed to high density printing tends to be lower than the desired density. Conversely, the actual printed density when high density printing is abruptly changed to low density printing tends to be higher than the desired density. Therefore, correction to increase the density and correction to decrease the density are necessary to obtain the desired printed density.

SUMMARY OF THE INVENTION

In view of the above described background art, an object of the present invention is to provide a method of controlling printed density capable of providing accurate print grade, even if temperature gradient in the thermal head is at non-steady state.

Another object of the present invention is to provide a method of controlling printed density in which correction to provide desired printed density can be realized only by the correction to reduce the density.

According to the present invention, the method of controlling printed density in thermal transfer printing includes the steps of: preparing in advance and maintaining a density table representing relation between energy pulses applied to heating elements and actual density printed by the energy pulses in a state in which there is no temperature gradient between heating elements and a temperature detector, in a thermal head including the heating elements and the temperature detector, for various uniform temperatures of the thermal head; when printing is continued by repetitively applying constant pulse energy for n times to the heating elements, based on relation between the number of repetition n of energy pulses and amount of increase of the actual printed density during n times of repetition of the energy pulses, determining, dependent on the number of repetition n of the energy pulses a temperature gradient coefficient for estimating temperature gradient between the heating elements and the temperature detector; calculating density correcting amount from a ratio of the temperature gradient coefficient after repetition of energy pulses for more than a prescribed number of times to the temperature gradient coefficient after repetition of n times; and applying pulse energy to the heating elements, which pulse energy is provided by subtracting energy corresponding to the density correcting amount from the pulse energy corresponding to the desired printed density calculated from a density table corresponding to the temperature measured by the temperature detector, whereby desired printed density can be accurately provided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
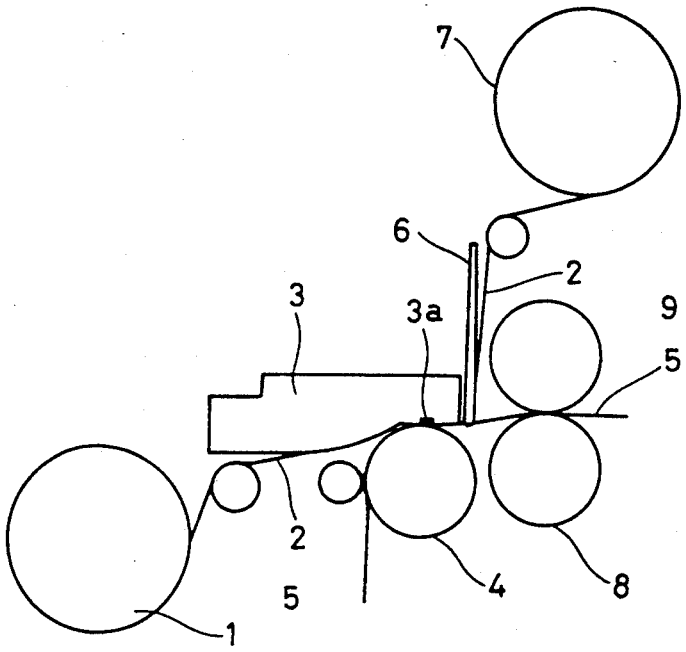
FIG. 1 is a schematic view showing an example of a main portion of a thermal transfer printer.
Figure 2:
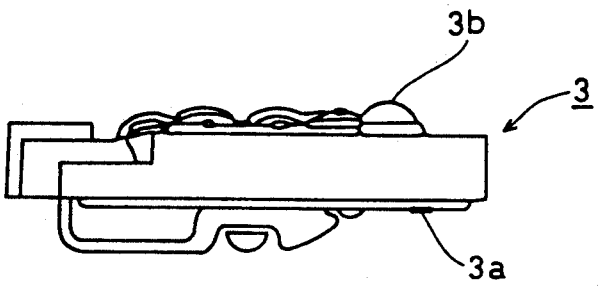
FIG. 2 is a cross sectional view of a thermal head which can be used in the thermal transfer printer of FIG. 1.
Figure 3:
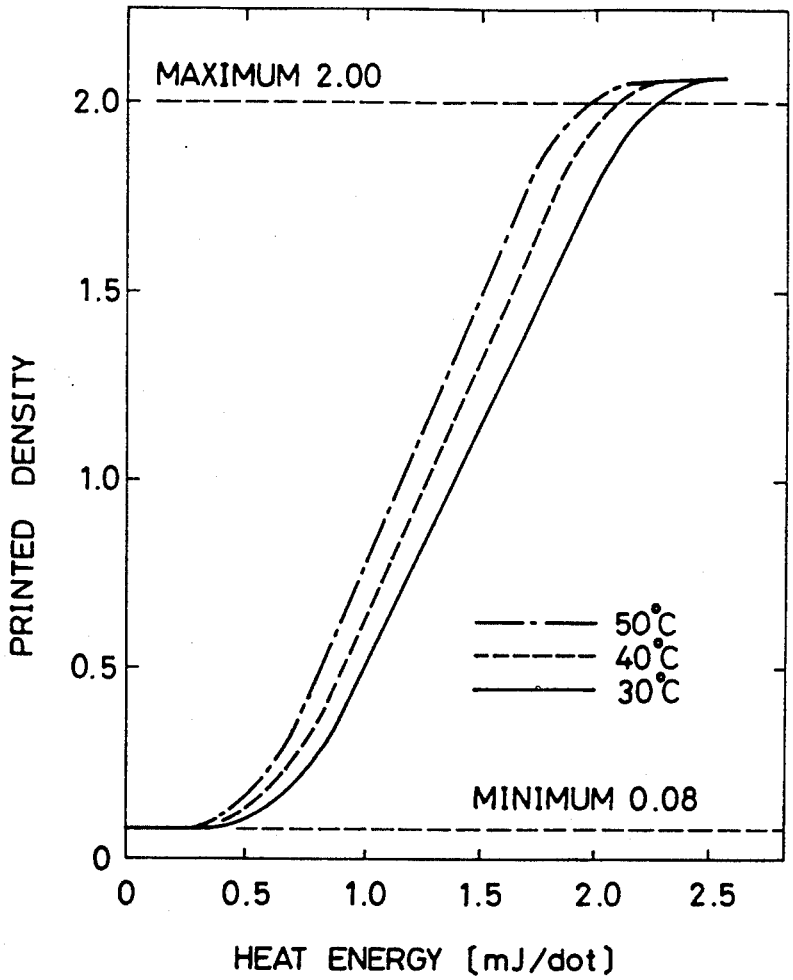
FIG. 3 is a graph showing relation between heating energy and actual printed density dependent on the temperature of the thermal head.

In the method apparatus of controlling printed density in dye diffusion type thermal transfer printing in accordance with one embodiment of the present invention, a density table representing relation between the energy pulses applied to the heating elements 3*a* and the actual printed density, when there is no temperature gradient between the heating elements 3*a* and the temperature detector 3*b* shown in FIG. 2 (hereinafter, this state is referred to as a uniform temperature state of the thermal head 3), is prepared for various uniform temperatures of the thermal head 3 based on experiments.

Figure 4:
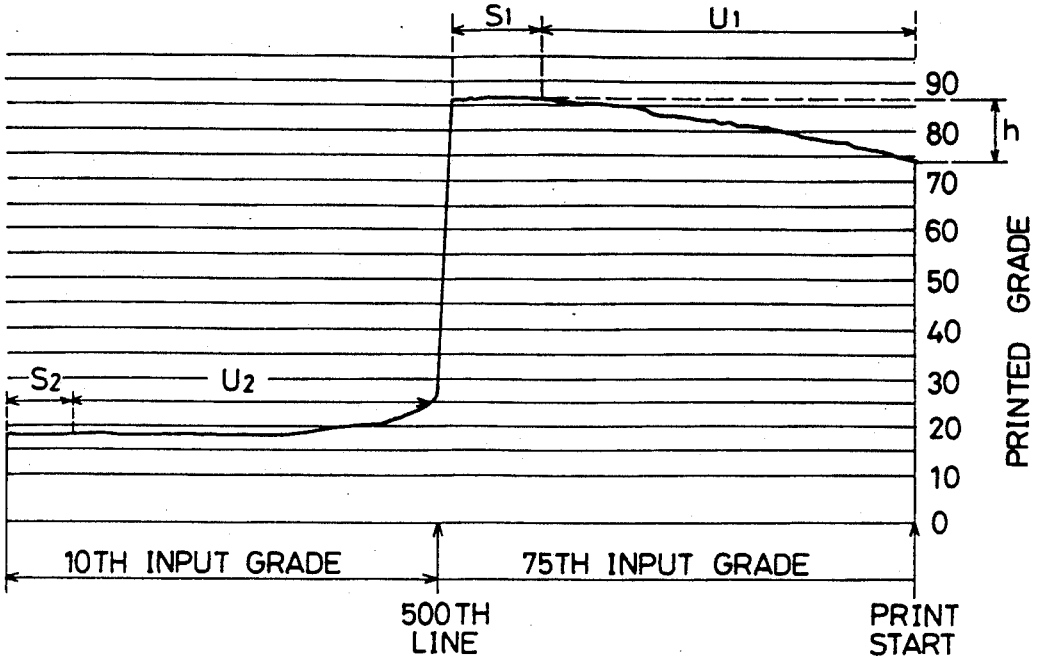
FIG. 4 is a diagram showing changes in the actual printed density when printing of a constant target density is continued by using a density table formed with the thermal head being at a uniform temperature state.

FIG. 4 is a diagram showing a change in the actual printed density when printing of a constant target density is continuously carried out using the density table formed at the uniform temperature state of the thermal head 3 described above. The horizontal parallel lines represent grade levels of the actual printed density. In FIG. 4, only a density table formed when there is no temperature gradient between the heating elements 3*a* and thermal detector 3*b*, with the thermal head 3 as a whole being at the room temperature is used. Therefore, at the start of printing, the desired density of 75th grade is provided accurately.

However, if printing of this input grade is continued, heat from the heating elements 3*a* is stored in the thermal head 3, and especially the temperature near the heating elements 3*a* increases gradually. Therefore, even if the input grade is constant at the 75th grade, the actual printed density gradually increases, exceeding the 75th grade. In the period (represented by a horizontal arrow $S_1$) after a certain period (represented by the horizontal arrow $U_1$) of continuous printing of a constant input grade, increase of the actual printed density is substantially stopped. At this time, the temperature gradient between the heating elements 3*a* and the temperature detector 3*b* in the thermal head 3 is at the steady state, and increase of temperature at the thermal head 3 is virtually stopped.

Then, if the input grade is changed to the 10th grade after the temperature steady state of the thermal head 3 corresponding to the continuous printing of the 75th grade is reached, the actual printed density becomes higher than the 10th grade. The reason for this is that while energy pulses corresponding to the 10th grade based on the temperature table prepared for the thermal head 3 as a whole at the room temperature are applied to the heating elements 3*a*, the temperature of the thermal head 3 is higher than the room temperature.

In the period represented by the horizontal arrow $U_2$ after the change of the input grade from the 75th grade to the 10th grade, the energy pulses applied to the heating elements 3*a* are smaller than those during printing at the 75th grade, so that the temperature of the thermal head 3 gradually lowers, and accordingly, the actual printed density is decreased. In the period represented by the horizontal arrow $S_2$ after the period $U_2$, lowering of the temperature of the thermal head 3 is stopped, and decrease of the printed density is also stopped.

However, even in the period $S_2$ in which the thermal head 3 is at the steady temperature state, the actual printed density is higher than the 10th input grade. The reason for this is that in the example of FIG. 4, energy pulses corresponding 10th input grade are applied based on the density table when the thermal head 3 as a whole is at the room temperature, although the temperature of the thermal head 3 is increased.

It should be noted that when a density table prepared based on a uniform temperature state of the thermal head 3 is used, correction of density to obtain desired printed density can be realized by the correction to reduce density only, and correction to increase density is not necessary.

In the present invention, amount of correcting printed density is calculated by estimating a temperature gradient between the heating elements 3*a* and the temperature detector 3*b*, based on the change in the actual printed density when printing of a constant target density is continued as shown in FIG. 4.

Accordingly, a temperature gradient coefficient $C_n$ for estimating the temperature gradient between the heating elements 3*a* and the temperature detector 3*b* is defined as the following recurrence formula (1):

$$C_n = r \cdot C_{n-1} + A_n \quad (1)$$

where $A_n$ represents target printed density of the nth line, and r ($0<r<1$) represents a correction coefficient.

By developing a geometric progression of the formula (1), the following equation (2) is provided.

$$C_n = r^n \cdot C_O + A_n + r \cdot A_{n-1} + r^2 \cdot A_{n-2} + \ldots + r^{n-1} \cdot A_1 \quad (2)$$

Since there is no temperature gradient in the thermal head 3 at the 0th line before the start of printing, the following equation (3) is provided, with $C_0=0$.

$$C_n = A_n + r \cdot A_{n-1} + r^2 \cdot A_{n-2} + \ldots + r^{n-1} \cdot A_1 \quad (3)$$

Assuming that printing of a constant target density is effected on each line, there is a relation of the following equation (4).

$$A_1=A_2=\ldots=A_n \quad (4)$$

By substituting the equation (4) for the equation (3), the following equation (5) is provided.

$$C_n=A_n\cdot(1-r^n)/(1-r) \quad (5)$$

When n becomes infinite in the equation (5), the thermal head 3 is at the steady temperature state as in the periods $S_1$ and $S_2$ shown in FIG. 4, and at this time, the equation (5) is represented as the following equation (6).

$$C_\infty = \lim_{n\to\infty}\{A_n(1-r^n)/(1-r)\} = A_n/(1-r) \quad (6)$$

Namely, $C_n$ is the converged value of the temperature gradient coefficient $C_n$.

In other words, when printing of a constant density is continued and the value $C_n$ of the equation (5) gradually increases (corresponding to the period $U_1$ of FIG. 4) or the value gradually decreases (corresponding to $U_2$ of FIG. 4) to be substantially equal to the converged value $C_n$ of the equation (6), it can be considered that the thermal head 3 reached the steady temperature state.

Now, if n increases over a certain value $\nu$, the increase of $C_{n\geqq\nu}$ is substantially stopped, and $C_{n\geqq\nu}$ can be regarded as substantially equal to $C_n$. Therefore, when the following equation (7) is satisfied, it is determined that the converged state of the equation (6) is substantially realized.

$$C\nu-C_{\nu-1}=1 \quad (7)$$

By substituting the equation (5) for the equation (7), the following equation is provided.

$$\log r=-\log A\nu/(\nu-1) \quad (8)$$

It is experimentarily proved that the printed density near the 500th line or so becomes substantially constant when printing is continued with the target density being the 100th grade. Therefore, by substituting $A\nu=100$ and $\nu=500$ for the equation (8), the value $r=0.99$ is provided, and by substituting this value r for the equation (6), the following equation (9) is provided.

$$C\nu \fallingdotseq C_\infty=A_n/(1-0.99)=100A_n \quad (9)$$

Namely, the equation (9) represents the converged value of the temperature gradient coefficient.

Figure 5:
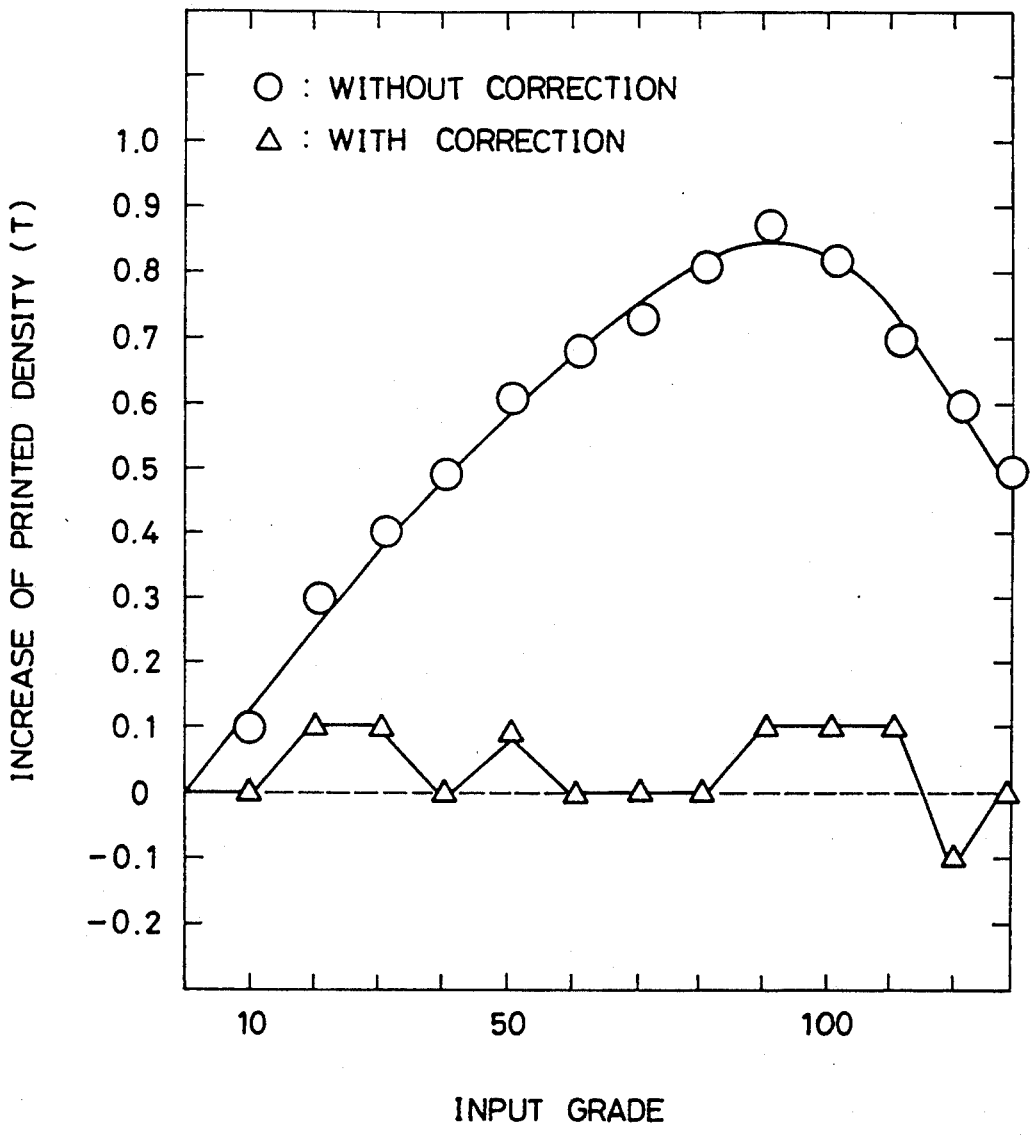
FIG. 5 is a graph showing relation between input grade and actual printed density.

FIG. 5 is a graph showing relation between the input grade and the actual printed density. In the graph, the abscissa represents the input grade or target grade. The ordinate represents degree of deviation between the actual printed density and the input grade. More specifically, the ordinate represents a value provided by multiplying the OD value per 1 grade by a value h. The OD value per 1 grade means a value provided by dividing a difference between maximum OD value which can be printed and the OD value of the recording paper itself by the maximum number of grades. The value h represents, for a constant input grade, a difference between the actually printed grade when the thermal head is at the steady temperature state and the actual printed grade when the thermal head is at a uniform temperature state, as shown in FIG. 4. The marks ○ in the graph show a result when printing is continued without any correction of density.

If a value provided by the curve with ○ marks of the graph of FIG. 5 is represented by T, the amount for grade $H_n$ to be corrected of the printed density on the nth line is provided by the following equation (10).

$$H_n=(C_n/C_\infty)\times T \quad (10)$$

More specifically, in order to accurately provide the desired grade on the nth line, pulse energy corresponding to the corrected grade $B_n=A_n-H_n$, provided by subtracting the correcting grade $H_n$ from the input grade $A_n$, must be applied to the heating elements 3a.

Figure 6:
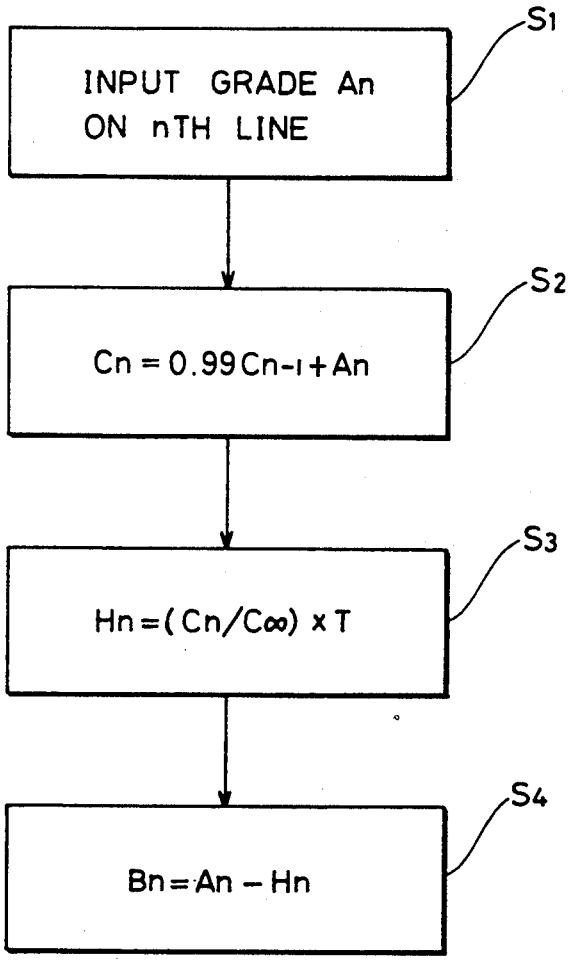
FIG. 6 is a flow chart showing processes of correcting density in accordance with the present invention.

FIG. 6 shows the processes of print density correction described above. First, in step S1, an input grade $A_n$ for the nth line is provided. When the input grade $A_n$ is provided, the temperature gradient coefficient $C_n$ can be calculated in step S2. In step S3, the correction grade amount $H_n$ is calculated by using the temperature gradient coefficient $C_n$. Finally, in step S4, the corrected grade $B_n$ corrected by subtracting the correcting grade amount $H_n$ from the input grade $A_n$ is calculated.

Figure 7:
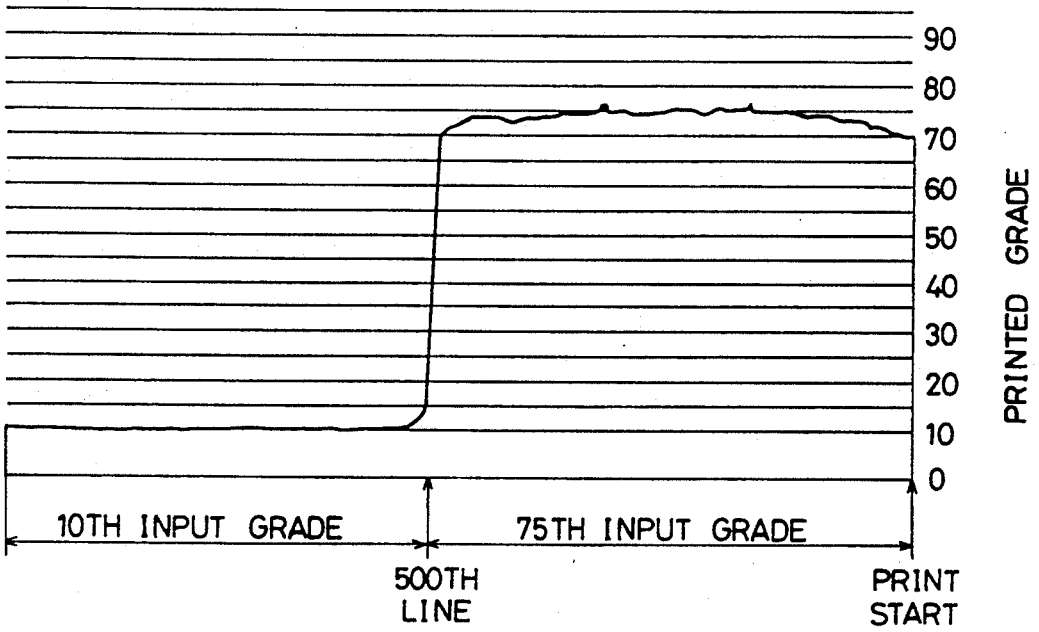
FIG. 7 is a graph showing one example of change in density during continuous printing with density correction effected in accordance with the present invention.

The result of actual printing with the above described correction is represented by the marks Δ in the graph of FIG. 5. The change in the actual printed density when the printing with the 75th input grade is continued with similar correction and thereafter printing is continued with the input grade changed to the 10th grade is shown in FIG. 7. It could be understood from the marks Δ in FIG. 5 and from FIG. 7, that the difference between the desired printed density and the actual printed density can be made sufficiently small, by the method of correcting printed density in accordance with the present invention. It is also understood that by the method of correcting printed density in accordance with the present invention, proper density correction is done even at the start of printing or at an abrupt change of printing density.

Figure 8:
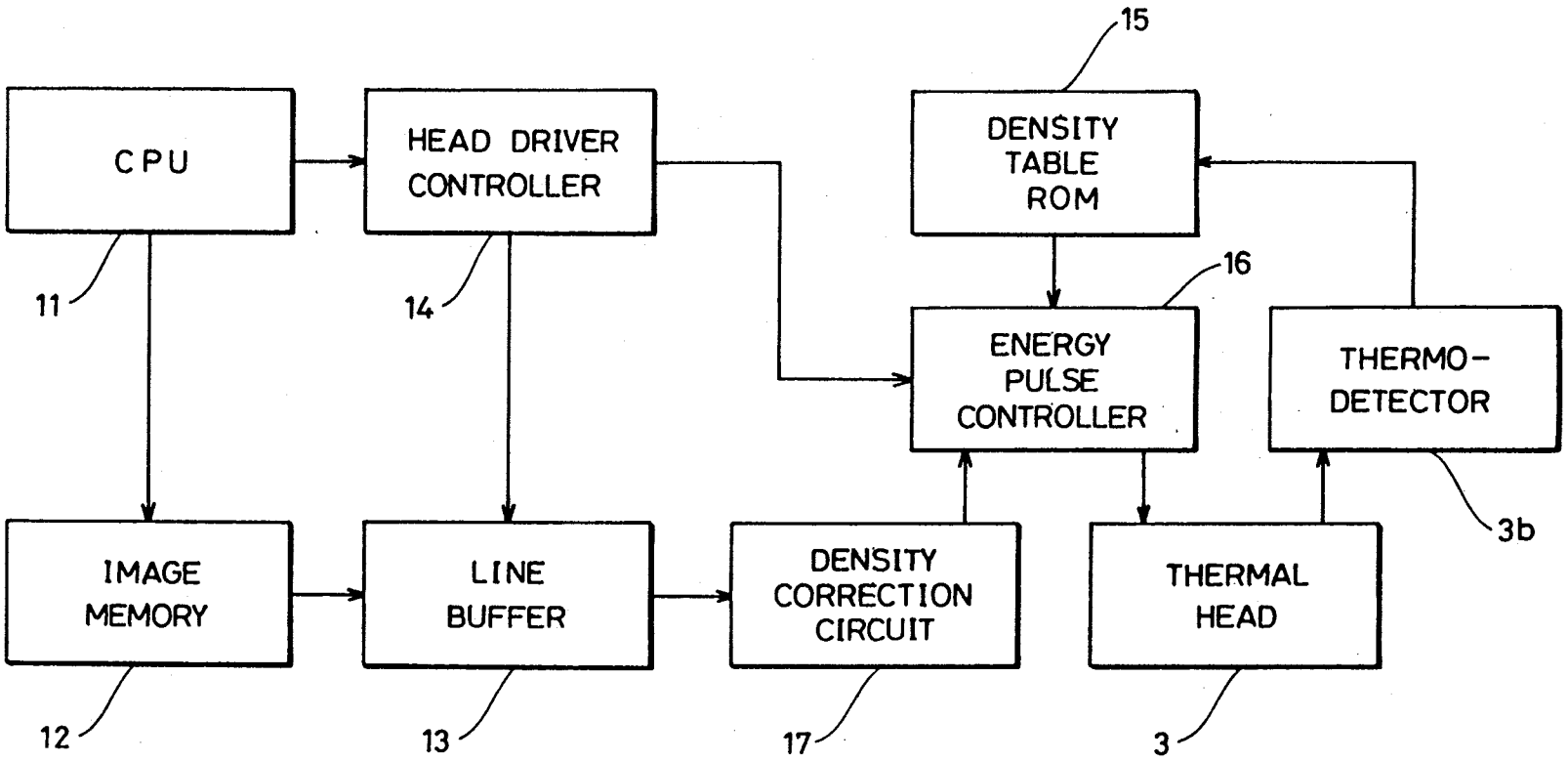
FIG. 8 is a block diagram showing one example of a thermal transfer printer in which density correction of the present invention can be carried out.

FIG. 8 is a block diagram showing an example of a thermal transfer printer in which the method of correcting printed density of the present invention can be carried out. A CPU (Central Processor Unit) 11 is a system controller controlling the thermal transfer printer as a whole. An image memory 12 holds data of 1 image. A line buffer 13 is controlled by a head driver controller 14 to receive and store data line by line from the image memory 12. A density correcting circuit 17 calculates the density correcting amount based on the data applied from the line buffer 13. A density table ROM (Read Only Memory) 15 stores a density table which is prepared when the thermal head 3 is at a uniform temperature state. An energy pulse controller 16 controlled by the head driver controller 14 determines energy pulses to be applied to the heating elements of the thermal head 3, based on the data applied from the density correcting circuit 17, while referring to the temperature table corresponding to the temperature detected by a temperature detector 3b on the thermal head 3.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of controlling printed density in thermal transfer printing using a thermal printer head with heating elements and a temperature detector, comprising the steps of:

preparing in advance a density table representing a relation between energy pulses applied to heating elements of the head and actual density printed by the energy pulses in a state in which there is no temperature gradient between said heating elements and said temperature detector for various uniform temperatures of the thermal head, and storing the table in a memory;

calculating density correcting amount for printing by using said table; and applying pulse energy to said heating elements, which pulse energy is provided by subtracting energy corresponding to said density correcting amount from pulse energy corresponding to a prescribed printed density calculated from said density table corresponding to the temperature measured by the temperature detector, whereby desired printed density can be accurately provided.

2. A method of controlling printed density in thermal transfer printing using a thermal printer head with heating elements and a temperature detector, comprising the steps of:

preparing in advance a density table representing a relation between energy pulses applied to heating elements of the head and actual density printed by the energy pulses in a state in which there is no temperature gradient between said heating elements and said temperature detector for various uniform temperatures of the thermal head, and storing the table in a memory;

calculating density correcting amount for printing by using said table;

determining, when printing is continued by repetitively applying constant pulse energy to said heating elements for n times, based on relation between the number of repetition n of energy pulses and amount of increase of the actual printed density during n times of repetition of the energy pulses, a temperature gradient coefficient for estimating temperature gradient between the hearing elements and the temperature detector, dependent on the number of repetition;

calculating said density correcting amount from a ratio of the temperature gradient coefficient after repetition of said energy pulses for more than a predetermined number of times;

applying pulse energy to said heating elements, which pulse energy is provided by subtracting energy corresponding to said density correcting amount from pulse energy corresponding to a prescribed printed density calculated from said density table corresponding to the temperature measured by the temperature detector, whereby desired printed density can be accurately provided.

3. A thermal transfer printer comprising:

a thermal head including a plurality of heating elements;

temperature detector detecting temperature of said thermal head;

a density table ROM for storing a density table representing a relation between energy pulses applied to the heating elements and actual density printed by the energy pulses when there is no temperature gradient between said heating elements and the temperature detector, for various uniform temperatures;

a density correcting circuit for correcting data by determining, when printing is continued by repetitively applying a constant pulse energy for n times to said heating elements, based on relation between said number of repetition n of the energy pulses and amount of increase of the actual printed density during n times of repetition of the energy pulses, determining a temperature gradient coefficient for estimating a temperature gradient between said heating elements and said temperature detector, dependent on the number of repetition n of said energy pulses, and calculating density correcting amount from a ratio of said temperature gradient coefficient after said n times of repetition to said temperature gradient coefficient after repetition of said energy pulses for more than a predetermined number of times; and an energy pulse controller for determining energy pulses to be applied to the heating elements of said thermal head based on said density table for a temperature detected by said temperature detector on said thermal head, based on corrected data applied from said density correcting circuit, and for applying the energy pulses to said thermal head.

4. The method according to claim 2, wherein said temperature gradient coefficient is calculated based on experiment data utilizing a recurrence formula.

* * * * *